US007318457B2

(12) United States Patent
Pages et al.

(10) Patent No.: US 7,318,457 B2
(45) Date of Patent: Jan. 15, 2008

(54) HEALD FRAME AND A WEAVING MACHINE INCLUDING AT LEAST ONE SUCH HEALD FRAME

(75) Inventors: Jean-Pierre Pages, Faverges (FR); Bertrand Cazin, Faverges (FR)

(73) Assignee: Staubli Faverges, Faverges (FR)

( * ) Notice: Subject to any disclaimer, the term of this patent is extended or adjusted under 35 U.S.C. 154(b) by 8 days.

(21) Appl. No.: 10/565,213

(22) PCT Filed: Jul. 20, 2004

(86) PCT No.: PCT/FR2004/001922

§ 371 (c)(1),
(2), (4) Date: Jan. 20, 2006

(87) PCT Pub. No.: WO2005/010253

PCT Pub. Date: Feb. 3, 2005

(65) Prior Publication Data

US 2006/0225805 A1 Oct. 12, 2006

(30) Foreign Application Priority Data

Jul. 21, 2003 (FR) ..... 03 08870

(51) Int. Cl.
*D03C 9/00* (2006.01)
*D03C 9/06* (2006.01)
*D03C 13/00* (2006.01)

(52) U.S. Cl. ..... 139/91; 139/92; 139/82; 139/87

(58) Field of Classification Search ..... 139/91, 139/92, 82, 87
See application file for complete search history.

(56) References Cited

U.S. PATENT DOCUMENTS 4,015,638 A * 4/1977 Graf ..... 139/91
4,015,639 A * 4/1977 Koch ..... 139/92
4,275,772 A * 6/1981 Shimizu ..... 139/91
4,307,757 A * 12/1981 Shimizu ..... 139/91
4,349,052 A * 9/1982 Yaji et al. ..... 139/92

(Continued)

FOREIGN PATENT DOCUMENTS

FR 2542332 A 9/1984

OTHER PUBLICATIONS

Patent abstract of Japan vol. 1997, No. 02, Feb. 28, 1997, JP 08269836A Oct. 15, 1996.

*Primary Examiner*—Gary L. Welch
*Assistant Examiner*—Robert H Muromoto, Jr.
(74) *Attorney, Agent, or Firm*—Dowell & Dowell, P.C.

(57) ABSTRACT

A heald frame including two posts, two cross members and connectors which are used for securing at least one post to at least one corresponding cross member. Each connector includes an intermediate tubular fixing element which is disposed in a housing provided in the cross member and indented with respect to a front face of the cross member and which element defines an internal volume in which a protrusion extending from the at least one post is seated.

18 Claims, 1 Drawing Sheet

U.S. PATENT DOCUMENTS 4,355,667 A * 10/1982 Shimizu ..... 139/91
4,369,815 A * 1/1983 Gehring et al. ..... 139/57
4,552,185 A * 11/1985 Graf ..... 139/91
4,687,030 A * 8/1987 Faasse ..... 139/91
4,741,367 A * 5/1988 Kitawaki ..... 139/91
4,750,526 A * 6/1988 Faasse et al. ..... 139/91
4,753,273 A * 6/1988 Gaisser ..... 139/91
4,832,088 A * 5/1989 Palau ..... 139/91
4,901,767 A * 2/1990 Koch ..... 139/92
5,004,019 A * 4/1991 Blontrock ..... 139/91
5,005,607 A * 4/1991 Shimizu ..... 139/91
5,197,522 A * 3/1993 Bilek et al. ..... 139/91
5,297,589 A * 3/1994 Baumann ..... 139/91
5,341,850 A * 8/1994 Froment et al. ..... 139/79
5,345,974 A * 9/1994 Bernardi et al. ..... 139/91
5,351,719 A * 10/1994 Graf ..... 139/91
5,411,061 A * 5/1995 Faase ..... 139/91
5,433,254 A * 7/1995 Pages ..... 139/82
5,477,889 A * 12/1995 Faase et al. ..... 139/91
RE35,858 E * 7/1998 Faasse ..... 139/91
5,819,810 A * 10/1998 Kramer et al. ..... 139/91
5,887,629 A * 3/1999 Mettler et al. ..... 139/91
6,131,619 A * 10/2000 Faasse et al. ..... 139/92
6,732,767 B2 * 5/2004 Baumann ..... 139/92
2003/0062093 A1 * 4/2003 Baumann ..... 139/87
2005/0081942 A1 * 4/2005 Schwane et al. ..... 139/92
2006/0225805 A1 * 10/2006 Pages et al. ..... 139/82

* cited by examiner

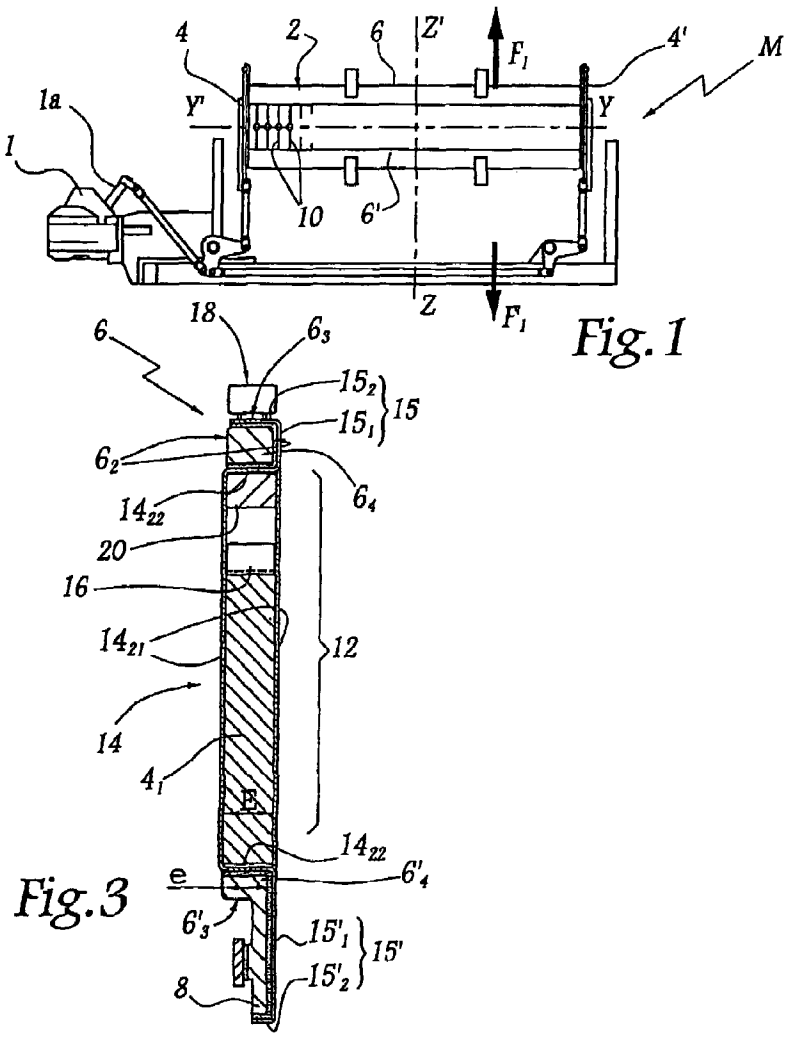
Fig. 1
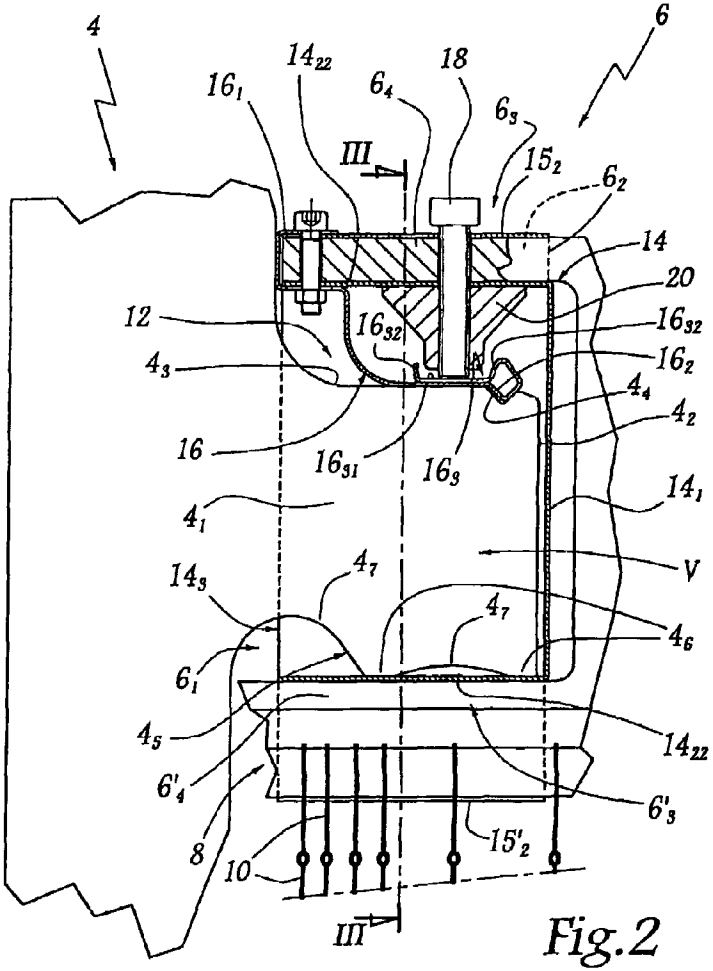
Fig. 2
Fig. 3

HEALD FRAME AND A WEAVING MACHINE INCLUDING AT LEAST ONE SUCH HEALD FRAME

BACKGROUND OF THE INVENTION

1. Field of the Invention

The present invention relates to a heald frame, and to a weaving machine equipped with such a frame.

2. Description of the Related Art

It is known to equip a weaving machine with heald frames which are to be driven in a vertically oscillating movement by means of an appropriate device, such as a heald loom or a dobby. To that end, each heald frame is produced by the reversible assembly of two posts and two cross-members, the posts being substantially vertical when the heald frame is in the use configuration, while the cross-members are substantially horizontal.

The mutual fixing of each post and of each cross-member is described especially in FR-A-2 542 332.

According to the teaching of that document, each cross-member is hollowed out, at its two ends, to form a corresponding recess in which a protrusion of the post is received. In addition, the protrusion is retained in the recess by the action of a clamping screw cooperating with a threaded block that is integral with the cross-member.

However, this known solution has some disadvantages.

The presence of the recess in the cross-member results in the formation of two thin front walls bordering the recess. Those thin portions, which work in traction, do not have sufficient strength, given their small thickness.

It would, of course, be possible to compensate for this mechanical weakness by reinforcing the above-mentioned thin walls. However, this would render the cross-member as a whole much heavier.

The problems identified above are increasingly crucial in so far as it is desired to operate weaving machines at increasingly high speeds, which involves making the heald frames as light as possible in order to reduce their inertia, thus reducing the mechanical strength of the cross-members. By contrast, the mechanical connections between the post and the cross-members must be increasingly strong in order to withstand the increasingly violent accelerations and decelerations to which those movable parts are subjected.

THE INVENTION

In the light of the above, the invention aims to remedy the disadvantages of the known devices by proposing a strong heald frame that is capable of being mounted on a machine operating at high speed.

To that end, it relates to a heald frame for a weaving machine, the frame including two posts and two cross-members, each of which is equipped with a heald-carrying bar, while there are provided connector means for fixing at least one post relative to at least one corresponding cross-member. The connector means including an intermediate tubular fixing element that is seated within an indentation or indented housing or recess formed in the cross-member and which element defines an internal volume in which a protrusion from the post is at least partially received. There are also provided securing means for securing the tubular fixing element within the housing and retention elements for the mutual connection of the tubular fixing element and the cross-member.

The invention relates also to a weaving machine equipped with at least one heald frame as defined above.

DESCRIPTION OF THE DRAWINGS

The invention will be better understood, and other advantages thereof will become more clearly apparent, in the light of the description which will be given hereinbelow of a weaving machine and of a heald frame in accordance with the principle of the invention, which description is given solely by way of non-limiting example and with reference to the accompanying drawings, in which:

FIG. 1 is a diagrammatic view of a weaving machine according to the invention;

FIG. 2 is a partial longitudinal section showing a heald frame of the machine of FIG. 1, in the region of the ends of one of its posts and one of its cross-members, respectively; and FIG. 3 is a section according to line III-III in FIG. 2.

DESCRIPTION OF THE PREFERRED EMBODIMENTS

In FIG. 1, a dobby 1 is intended to move a heald frame 2 of a weaving machine M, according to a vertically oscillating movement represented by the arrows $F_1$ and $F'_1$. To that end, a driving arm 1*a* of the dobby 1 is coupled to each heald frame by way of rods and oscillating levers.

Each frame 2 comprises an assembly of two posts 4, 4' and two cross-members 6, 6'. The posts/extend generally in a direction parallel to the direction of vertical oscillation Z-Z' of the frames 2, while the cross-members extend generally in a direction Y-Y' perpendicular to the direction Z-Z' and generally horizontal during operation of the machine M.

In the present description which follows, the connection between the left-hand post 4 and the upper cross-member 6 of a frame 2 will be studied in greater detail. It will be understood that the assembly of that cross-member 6 with the right-hand post 4', or the assembly of the lower cross-member 6'with one or other of the posts 4, 4', can incorporate the same structural and functional characteristics.

Referring more particularly to FIGS. 2 and 3, $\mathbf{6}_1$ denotes the principal end of the cross-member 6, corresponding to its major dimension or length. $\mathbf{6}_2$ denotes the front faces of the cross-member 6, which thus extend, during operation, facing other cross-members. Finally, $\mathbf{6}_3$ and $\mathbf{6'}_3$ denote the side walls of the cross-member 6.

One of the side walls, $\mathbf{6'}_3$, in this case the lower side wall, is prolonged in a known manner by a foot 8 which forms a heald-carrying bar to which healds 10 for guiding the warp threads of the machine M can be attached. In this respect, the lower cross-member 6' is likewise provided with another heald-carrying bar (not shown).

The cross-member 6 is hollowed out to form an indentation, housing or recess 12 which opens in the region of the principal end $\mathbf{6}_1$ of the cross-member. The indentation 12 also opens at the front faces $\mathbf{6}_2$, that is to say extends over the entire thickness of the cross-member.

By contrast, the indentation does not extend over the whole of the height of the cross-member, that is to say does not open in the region of the side walls $\mathbf{6}_3$, $\mathbf{6'}_3$ thereof. Consequently, the indentation 12 is bordered by lateral end tabs, denoted $\mathbf{6}_4$ and $\mathbf{6'}_4$.

A hollow sleeve 14 forming an intermediate tubular fixing element or high mechanical strength connector between the cross-member and the post is received in the above-mentioned indentation 12. The sleeve 14, which is produced, for example, from a tubular member which has been cut to the appropriate size, has side walls which, in transverse section, generally form a rectangle.

$14_{21}$ denotes the long sides of the rectangle, and $14_{22}$ denotes the short sides thereof. As is shown especially in FIG. 3, the front dimension, or thickness E, of the sleeve 14 is greater than the front dimension, or thickness e, of the cross-member 6. However, it is possible for the thickness E to be less than or equal to the thickness e of the cross-member.

The hollow sleeve 14 defines an internal volume V in which a protrusion of the post 4 can be received, as will be seen hereinbelow. The protrusion can be introduced into the internal volume V, which forms a receiving recess, through an opening $14_3$ allowing access to the inside of the sleeve.

As is shown especially in FIG. 2, the side walls of the hollow sleeve 14 are prolonged by an integral base denoted $14_1$. The base $14_1$, which is provided on the opposite side from the above-mentioned opening $14_3$, imparts satisfactory strength to the sleeve 14 while forming a barrier to the fixing adhesive, in order to isolate the internal volume of the sleeve.

There are additionally provided securing means for fixing the sleeve relative to the cross-member 6. In the present case, the short sides 1422 are adhesively bonded to the facing walls of the tabs 64 and 6'4 bordering the indentation 12, As is shown especially in FIG. 3, the side walls 2421 and 1422 of the sleeve 14 are prolonged by extensions 15 and 15' which extend from the upper right-hand and lower right-hand angles, respectively, of the rectangle formed by the sides walls in transverse section.

More precisely, each extension 15, 15' first of all comprises a vertical foot $15_1$, $15'_1$, as well as an end return portion $15_2$, $15'_2$, which extends horizontally. The feet and the return portions, which are adhesively bonded to the facing walls of the cross-member, allow the surface area for adhesive bonding between the sleeve 14 and the cross-member 6 to be increased, which ensures a particularly reliable connection between the sleeve and the cross-member.

The sleeve 14 is advantageously made of a metal having high mechanical strength, for example stainless steel. By way of variation, it may be made of a light metal alloy, such as aluminium, in so far as its side walls $14_{21}$ can be made thicker, and therefore stronger, than the side walls of the cross-member.

FIGS. 2 and 3 also show a resilient plate 16 which is fixed by screwing, at a first end $16_1$, to the free end of the upper tab $6_4$. The resilient plate 16, which penetrates into the internal volume V of the sleeve 14, has a bent limb $16_2$ which is prolonged by a U-shaped end return portion $16_3$. The core $16_{31}$ of the return portion $16_3$ extends in the vicinity of the principal portion of the resilient plate 16, which is itself in contact with the stud $4_1$.

Away from its free end, the upper tab $6_4$ receives a screw 18 which penetrates into a threaded block 20, forming a nut, which is accommodated in the sleeve. The block 20, which is held in position laterally by the wings $16_{32}$ of the U-shaped return portion $16_3$, bears against the wall $14_{22}$ of the sleeve 14.

Finally, the post 4 is provided with a protrusion $4_1$, forming a stud, which is intended to penetrate into the internal volume V of the sleeve 14. The stud $4_1$ has a flat front face $4_2$ which extends, during operation, in the vicinity of the end of the sleeve 14 remote from the access opening $14_3$.

The stud $4_1$ also has a first side wall $4_3$ which is provided with a notched portion $4_4$ intended to cooperate with the bent limb $16_2$. The other side wall $4_5$ of the stud $4_1$ has two flat surfaces $4_6$ for bearing on the opposing short side $14_{22}$ with which the sleeve 14 is provided.

The side wall $4_5$ also defines two curved surfaces $4_7$, the concavity of which is turned towards the inside of the sleeve 14. In that manner, the side wall $4_5$ bears on the sleeve only partly, owing to the presence of the curved surfaces $4_7$ extending at a distance from the sleeve.

When the stud $4_1$ is introduced into the internal volume V of the sleeve 14, through the opening $14_3$, the bent limb $16_2$ of the plate 16 penetrates into the notched portion $4_4$ of the stud $4_1$, ensuring the indexation thereof relative to the cross-member 6. It is to be noted that this phenomenon can readily be perceived by the operator, who accordingly has information regarding the correct positioning of the post 4 relative to the cross-member 6. It is then a question of mutually retaining those two elements by urging the screw 18 against the resilient plate 16 and, consequently, against the side wall $4_3$ of the stud $4_1$.

It is to be noted that the two flat surfaces $4_6$ and the screw 18 are offset relative to one another. This accordingly contributes to a satisfactory distribution of the forces to which the stud $4_1$ is subjected, given that the moments exerted by the surfaces $4_6$ and by the screw 18 are located at different locations on the stud $4_1$.

The invention has been represented by means of a particular type of mechanical device for the assembly of a post and a cross-member. It is applicable by means of other mechanisms, regardless of their exact type, and, in particular, by means of mechanisms of resilient and non-resilient connection which have the effect of inducing high stresses in the vertical walls or long sides of the cross-members.

By way of variation, it is possible for only one end of a post and/or of a cross-member to be produced in accordance with the invention, as described above. In this respect, the other end is the subject of a different type of fixing, using especially a non-removable connection.

The invention is applicable regardless of the material used for the parts constituting the frames. It is applicable especially to frames of a light metal alloy, such as aluminium, as well as to frames made of composite materials comprising an organic resin and reinforcing carbon or glass fibres.

The invention is applicable regardless of the geometry of the heald-carrying bars with which the cross-members are equipped, which may accordingly have different forms adapted to those of the ends of the healds.

The invention allows the objectives mentioned above to be achieved.

Retention of the stud of the post is achieved in principle by way of the fixing sleeve, which is capable of withstanding very high forces. The cross-member, on the other hand, is substantially not subjected to any stress due to such retention. Accordingly, the invention provides separation of functions, using an intermediate element that is more specifically dedicated to the mutual fixing of the cross-member and the post.

Moreover, the existence of two lateral tabs of the cross-member, bordering the receiving recess of the sleeve, is advantageous. It means that the mechanical characteristics of the cross-member do not have to be altered substantially, because the strong parts thereof are kept virtually in their totality.

Furthermore, in the case where the receiving indentation of the sleeve opens at the front faces of the cross-member, this allows the sleeve to be given a maximum width. In this case, the stud can then have a greater thickness and, consequently, good mechanical strength properties.

In addition, thanks to the invention, machining of the cross-member is simple and rapid. Finally, the mutual connection of the fixing sleeve and the cross-member is simple to carry out.

The invention claimed is:

1. A heald frame for a weaving machine, said frame comprising two posts and two cross members, each of said cross members being equipped with a heald carrying bar, connector means for connecting at least one post relative to at least one corresponding cross member, the connector means including a tubular fixing element seated within a housing indented within a front face of the at least one cross member, the tubular element defining an internal volume in which a protrusion from the at least one post is received, securing means for securing the tubular fixing element within the housing of the at least one cross member, and retention means for retaining the protrusion within the internal volume of the tubular fixing element.

2. The frame as claimed in claim 1, wherein the securing means for securing the tubular fixing element and the at least one cross member includes an adhesive.

3. The frame as claimed in claim 1, wherein the tubular fixing element is made of a high strength material selected from a group of materials consisting of steel, stainless steel, and light metal alloys including aluminium.

4. The frame as claimed in claim 1, wherein the housing opens at opposite front faces of the at least one cross member.

5. The frame as claimed in claim 4, wherein the tubular fixing element has a thickness dimension (E) that is greater than a thickness dimension (e) of the at least one cross member.

6. The frame as claimed in claim 1, wherein the housing does not open at side walls of the at least one cross member, such that the at least one cross member includes two lateral end tabs bordering the housing.

7. The frame as claimed in claim 1, wherein the tubular fixing element (14) has side walls that delimit an access opening to the volume in which the protrusion is received.

8. The frame as claimed in claim 7, wherein the tubular fixing element is closed by a base provided opposite the access opening.

9. The frame as claimed in claim 7, wherein the side walls form a rectangle when viewed in transverse section.

10. The frame as claimed in claims 6, wherein the tubular fixing element is adhesively bonded to the lateral end tabs.

11. The frame as claimed in claim 2, wherein the tubular fixing element includes at least one extension connected by the adhesive to facing walls of the at least one cross member.

12. The frame as claimed in claim 11, wherein the at least one extension extends from an intersection between a long side and a short side of side walls of the tubular fixing element.

13. The frame as claimed in claim 6, wherein the a retention means includes a screw which is mounted in one of the lateral end tabs, the screw cooperating with a nut mounted within the tubular fixing element, the screw applying a bearing force on the protrusion.

14. The frame as claimed in claim 13, including indexing means mounted within the tubular fixing element for engaging the protrusion as the protrusion is inserted into the volume of the tubular fixing element.

15. The frame as claimed in claim 14, wherein the engaging means includes a resilient plate that extends partially into the internal volume and that has a bent portion that is engageable within a notched portion of the protrusion.

16. The frame as claimed in claim 15, wherein the protrusion includes at least one flat bearing surface for bearing on an opposing face of the tubular fixing element the at least one flat bearing surface extending only over a portion of a side wall of the protrusion.

17. The frame of claim 16 wherein the protrusion includes at least first and second flat bearing surfaces that are spaced from one another by a convex surface of the side wall such that any force on the protrusion is distributed to spaced areas of the opposing face of the tubular fixing element.

18. A weaving machine, the weaving machine comprising at least one heald frame, the at least one heald frame including two posts and two cross members, each of the cross members supporting a heald carrying bar, connector means for securing at least one post relative to at least one corresponding cross member, the connector means including a tubular fixing element seated within a housing indented within a front face of the cross member, the tubular element defining an internal volume in which a protrusion from the at least one post is received, securing means for securing the tubular fixing element within the housing of the at least one cross member, and retention means for retaining the protrusion within the internal volume of the tubular fixing element.

* * * * *